US008701220B2

(12) United States Patent
Vargas et al.

(10) Patent No.: US 8,701,220 B2
(45) Date of Patent: Apr. 22, 2014

(54) JET POWERED TOILET FLUSHING SYSTEM

(75) Inventors: Matt Vargas, San Jose, CA (US); Tom Stout, San Jose, CA (US); Anurupa Rao, Sunnyvale, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 594 days.

(21) Appl. No.: 12/787,332

(22) Filed: May 25, 2010

(65) Prior Publication Data

US 2010/0299824 A1 Dec. 2, 2010

Related U.S. Application Data

(60) Provisional application No. 61/182,742, filed on May 31, 2009.

(51) Int. Cl.
*E03D 1/24* (2006.01)

(52) U.S. Cl.
USPC ..... 4/329; 4/331; 4/374

(58) Field of Classification Search
USPC ..... 4/378–383, 366, 368, 329–332
See application file for complete search history.

(56) References Cited

U.S. PATENT DOCUMENTS

| | | | | |
|---|---|---|---|---|
| 665,825 | A | | 1/1901 | Carroll |
| 1,232,767 | A | | 7/1917 | Camfield et al. |
| 1,839,424 | A | | 1/1932 | Tracey |
| 3,345,648 | A | * | 10/1967 | Rafferty ..... 4/324 |
| 3,851,338 | A | | 12/1974 | Roosa |
| 4,034,423 | A | | 7/1977 | Milnes |
| 4,170,048 | A | | 10/1979 | Anthony |
| 4,408,361 | A | | 10/1983 | Rozek |
| 4,918,763 | A | | 4/1990 | Brotcke |
| 5,033,129 | A | | 7/1991 | Gajewski |
| 5,036,553 | A | | 8/1991 | Sanderson |
| 5,274,855 | A | | 1/1994 | Franck, III |
| 5,305,475 | A | | 4/1994 | Jaeckels et al. |
| 5,363,513 | A | | 11/1994 | Blankenburg |
| 5,381,561 | A | | 1/1995 | Carson, III |
| 5,502,845 | A | | 4/1996 | Hayashi et al. |
| 5,515,556 | A | | 5/1996 | Johnson |
| 5,579,542 | A | | 12/1996 | Hayman |
| 5,666,675 | A | | 9/1997 | Rüegg |
| 5,729,837 | A | | 3/1998 | Jaeckels et al. |

(Continued)

FOREIGN PATENT DOCUMENTS

| | | |
|---|---|---|
| JP | 10-131257 | 5/1998 |
| JP | 2004-156382 | 6/2004 |

OTHER PUBLICATIONS

PCT Written Opinion and International Search Report, Jul. 13, 2010.

*Primary Examiner* — Gregory Huson
*Assistant Examiner* — Janie Christiansen
(74) *Attorney, Agent, or Firm* — Gordon & Rees LLP

(57) ABSTRACT

A jet powered toilet flushing system, including: a toilet bowl; a reservoir; a fluid conduit between the reservoir and the toilet bowl; a jet inside the reservoir, the jet having a nozzle directed toward an entrance of the fluid conduit; a fill valve that supplies water to the jet; and a flow diverter in the reservoir, the flow diverter positioned to divert water flow: (a) from the jet nozzle into the entrance of the fluid conduit when the reservoir is full, or (b) from the jet nozzle away from the entrance of the fluid conduit and into the reservoir when the reservoir is empty.

21 Claims, 9 Drawing Sheets

(56) References Cited

U.S. PATENT DOCUMENTS

| | | | |
|---|---|---|---|
| 5,857,224 | A | 1/1999 | Oberg et al. |
| 5,867,844 | A | 2/1999 | Jaeckels et al. |
| 5,887,294 | A | 3/1999 | Yeung |
| 5,913,611 | A | 6/1999 | Jaeckels et al. |
| 6,029,287 | A | 2/2000 | Ge et al. |
| 6,115,853 | A | 9/2000 | Shibata et al. |
| 6,145,138 | A | 11/2000 | Nakamura et al. |
| 6,360,378 | B2 | 3/2002 | Martin |
| 6,367,095 | B2 | 4/2002 | Hubatka et al. |
| 6,502,251 | B1 | 1/2003 | Teshima et al. |
| 7,010,816 | B2 | 3/2006 | Li |
| 7,159,251 | B2 | 1/2007 | Hennessy |
| 7,171,701 | B2 | 2/2007 | Kuster et al. |
| 2007/0113331 | A1 | 5/2007 | Prokopenko |

* cited by examiner

JET POWERED TOILET FLUSHING SYSTEM

CROSS-REFERENCE TO RELATED APPLICATION

The present application claims priority to provisional patent application Ser. No. 61/182,742 filed May 31, 2009, entitled "Tankless Flush Systems for Toilets," which is incorporated by reference into the present application as if set forth verbatim.

TECHNICAL FIELD

The present invention relates to toilets that flush without requiring an elevated water tank positioned above the toilet bowl, or a flapper flush valve positioned between an elevated water tank and the toilet bowl.

BACKGROUND OF THE INVENTION

Most conventional residential toilets make use of an elevated supply of water in a tank mounted above the toilet bowl. To flush the toilet, the user actuates a lever or button which releases the elevated water into the toilet bowl under the force of gravity. However, such elevated toilet tanks are bulky and unattractive, and are prone to leak risks. Therefore, a need exists for a toilet that flushes without requiring an elevated tank, and which is also suitable for both residential and commercial use.

Additionally, in recent years water conservation has become more important to many people and municipalities. In fact, many jurisdictions have laws limiting the amount of water that can be used per toilet flush. Also in response to the need for water conservation, dual flush toilets have been developed. In a dual flush toilet, there are two user-selectable flush sizes. A small flush is used to dispose of liquid waste. A large flush is used to dispose of solid waste. Preferably, the desired toilet would also be suitable for use with dual flush technologies. Importantly, water conservation includes both changing flush sizes and prevention of leak failures. Therefore, it is also desirable to provide a "flapperless" toilet since toilet flappers are prone to wear out and are also sensitive to harsh chemicals and grey water. As such, the elimination of the flapper valve is very desirable to reduce both the service expense and inconvenience of this messy and time-consuming replacement.

SUMMARY OF THE INVENTION

The present invention provides a toilet flushing system that requires no elevated water tank positioned above and behind the toilet bowl as seen in conventional gravity powered toilets. However, the present flush system offers many additional benefits and can optionally be used to replace a conventional flush system in a regular toilet as well.

In one preferred aspect, the present invention provides a jet powered toilet flushing system. This system comprises: (a) a toilet bowl; (b) a reservoir; (c) a fluid conduit between the reservoir and the toilet bowl; (d) a jet inside the reservoir, the jet having a nozzle directed toward an entrance of the fluid conduit; (e) a fill valve that supplies water to the jet; and (f) a flow diverter in the reservoir. The flow diverter in the reservoir is preferably positioned to divert water flow either: (i) from the jet nozzle into the entrance of the fluid conduit when the reservoir is full, or (ii) from the jet nozzle away from the entrance of the fluid conduit and into the reservoir when the reservoir is empty.

The jet nozzle is preferably positioned in the water reservoir below the mid-section of the fluid conduit. In operation, the passage of water from the jet nozzle into the entrance of the fluid conduit draws surrounding water from the reservoir into the fluid conduit as well. As a result, this creates a "siphon effect" wherein the fluid flow siphons water from the reservoir through the fluid conduit and into the toilet bowl (thereby flushing the toilet bowl).

An important novel feature of the present invention is its flow diverter. The flow diverter automatically directs fluid flow in one of two paths. Prior to a flush (i.e.: when the reservoir is full), flow from the jet nozzle is sent directly into the fluid conduit. This causes the contents of the reservoir to be siphoned into the toilet bowl, flushing the toilet bowl.

After a flush the water in the reservoir is substantially emptied. At this time, the water level in the reservoir drops to a low level such that the flow diverter then automatically blocks the flow of water shooting from the jet nozzle into the fluid conduit. This is done by blocking the entrance of the fluid conduit. Since no water is jetting into the fluid conduit entrance, the "siphon effect" is stopped. Therefore, the water in the reservoir does not drain into the toilet bowl. As a result, the flow of water simply passes into the reservoir itself, refilling the reservoir.

In preferred embodiments, the flow diverter comprises a float and a moveable gate. The float lifts the moveable gate away from a fluid path from the jet nozzle into the entrance of the fluid conduit when the reservoir is full (i.e.: prior to a flush). Similarly, the float lowers the moveable gate down into a fluid path from the jet nozzle into the entrance of the fluid conduit after the reservoir has been emptied (i.e.: immediately after the flush).

In further preferred embodiments, water flow from the jet nozzle is directed onto the moveable gate to keep the moveable gate in a lowered position blocking the entrance of the fluid conduit even after the reservoir has been substantially or fully refilled following a flush. Finally, when the reservoir has been fully refilled, the fluid flow out of the jet nozzle stops. Thus, there is no longer a fluid flow pressure holding the moveable gate down in its lowered position. At this time, the float on the diverter will then lift the gate, opening the entrance to the fluid conduit. As a result, the toilet is "reset" and ready for the next flush.

In preferred embodiments, the fill valve comprises a fill valve float. When the fill valve float is lowered in position, the fill valve supplies water into the jet. This fill valve float may optionally be lowered in one of two ways. First, it may be lowered when the water level in the reservoir drops immediately after a flush. Thus, the reservoir will automatically refill after water has been siphoned out of it and into the toilet bowl. Secondly, the float may be manually lowered in position by a user to initiate a flush. Specifically, manually pushing down on the float will cause water to flow to the jet—which will in turn cause the water in the reservoir to be siphoned into the toilet bowl (as explained above). Once flow to the jet is initiated, the water level in the reservoir becomes lower allowing the weight of the float to keep the fill valve open during the flush. In one optional embodiment, the reservoir has a narrowed top portion, and the fill valve float is positioned within the narrowed top portion of the reservoir to facilitate this action.

A first advantage of the present invention is that a single water supply line into the reservoir is used both to initiate jet siphon flow (i.e.: flushing the toilet bowl) and to refill the reservoir after a flush. In contrast, existing jet flow systems use one line to initiate a jet siphon flow and separate input flow line to refill the tank. As a result, these existing jet flow systems also require many additional controls and valves to operate.

A second advantage of the present invention is that it avoids the flexible flapper valve that commonly separates an elevated toilet water tank from the toilet bowl below. Flexible flapper valves are typically the weakest part of a toilet system and are therefore the most prone to malfunction (causing water to leak from the toilet tank down into the toilet bowl). As a result, the flapper valve is typically the first part of the toilet system to be replaced.

A third advantage of the present system is that it conserves water since tank-to-bowl water leakage is completely avoided (as there is no elevated tank sitting above the bowl and thus no flapper valve separation of the tank and bowl).

A fourth advantage of the present system is that it is easy to install, maintain and operate, and can be used with different bowl sizes and geometries. The present system has few moving fluid parts than conventional elevated tank toilets and is thus better adapted to harsh water conditions due to chemicals or even grey water reuse. Lastly, other advantages of the present invention are that it provides a very consistent flush; and it is durable and long lasting.

DETAILED DESCRIPTION OF THE DRAWINGS

Exemplary embodiments of the inventions are described below. The figures are not necessarily drawn to scale and do not necessarily show every detail or structure of the various embodiments of the inventions, but rather illustrate exemplary embodiments and mechanical features in order to provide an enabling description of such embodiments.

Figure 6:
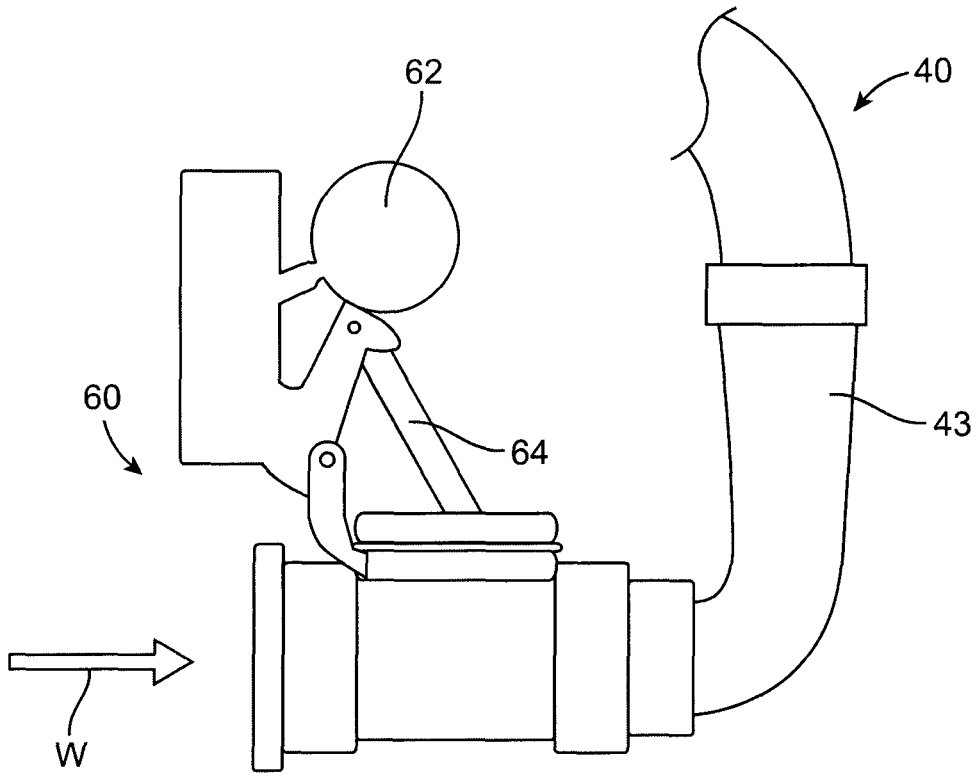
FIG. 6 is an enlarged view of the flow diverter in the "up" position.
Figure 7:
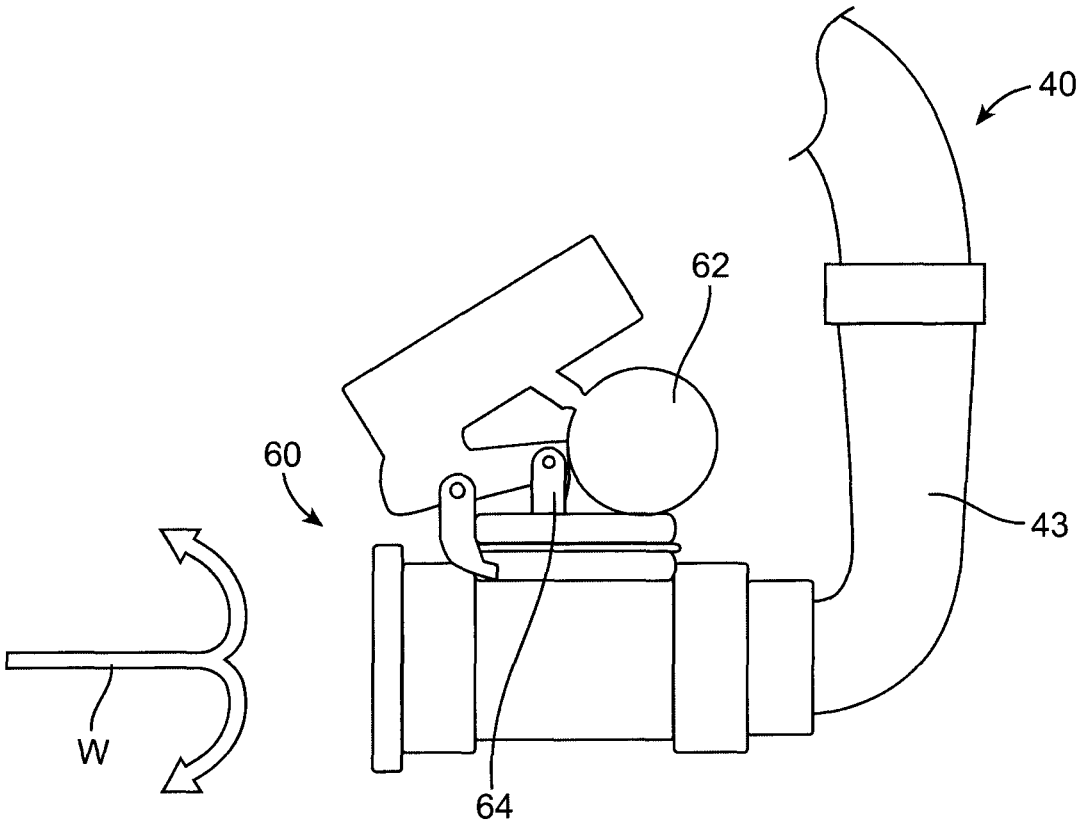
FIG. 7 is an enlarged view of the flow diverter in the "down" position.
Figure 8:
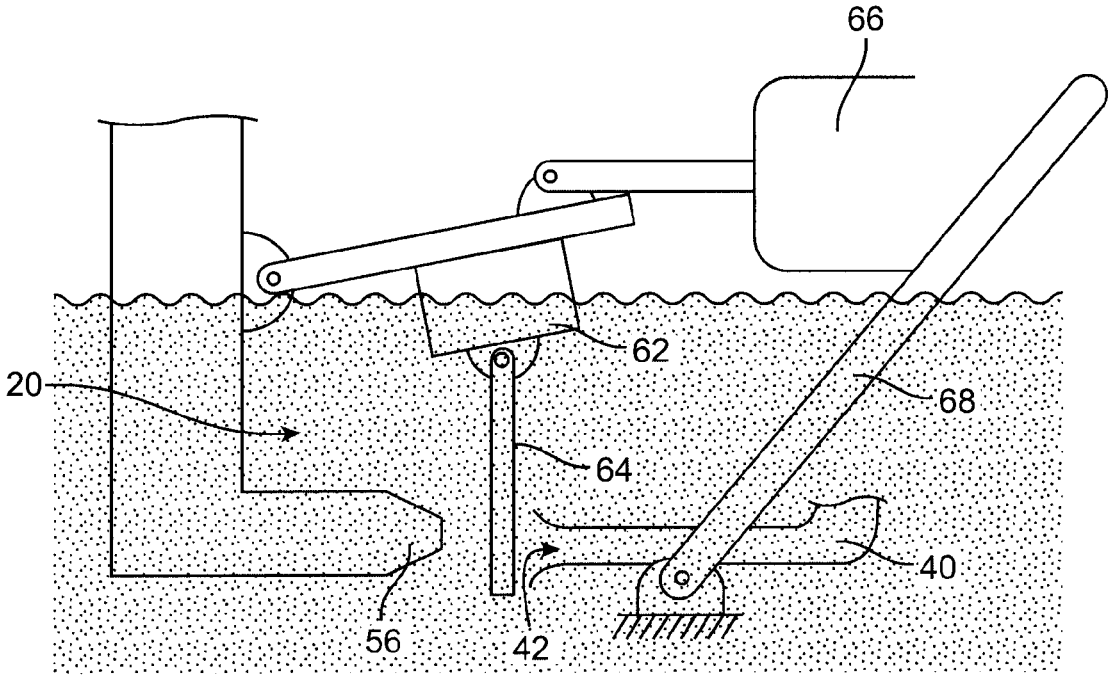
FIG. 8 is a schematic view of the present system configured for "dual flush" in the full flush position.
Figure 9:
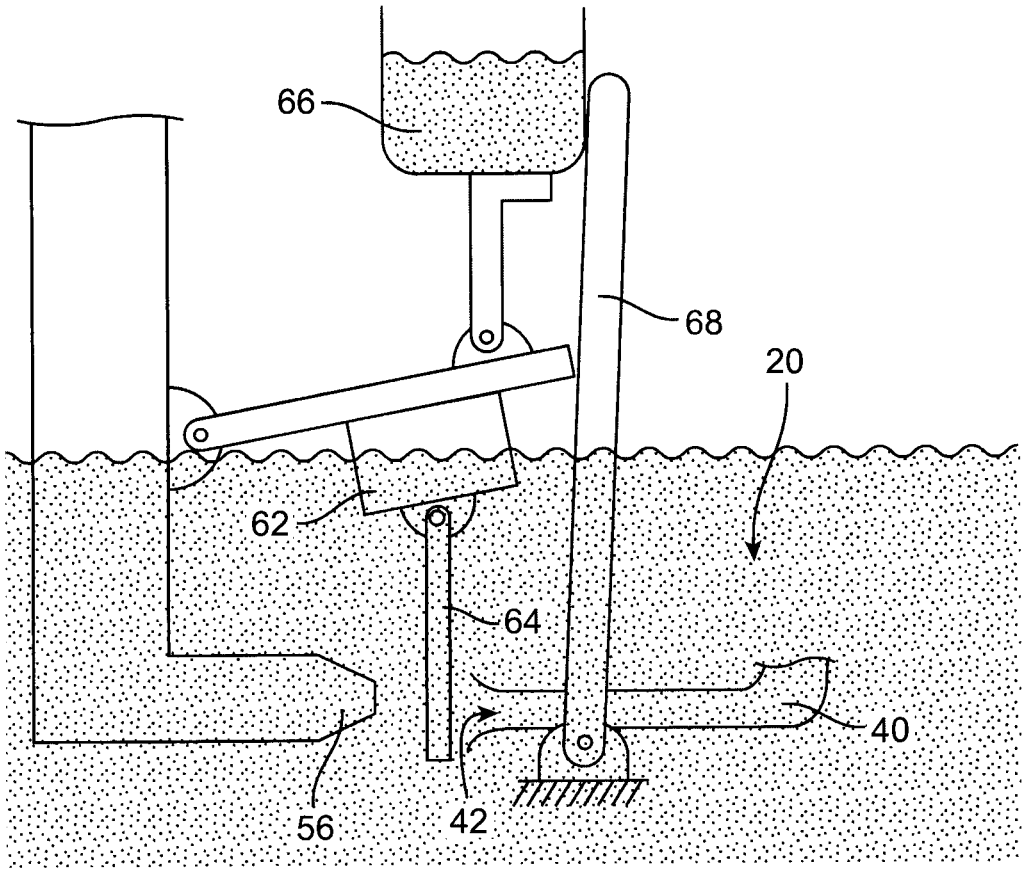
FIG. 9 is a schematic view of the present system configured for "dual flush" in the partial flush position.

FIGS. 1 to 5 show sequential steps in the operation of the present jet powered toilet flushing system. FIGS. 6 and 7 show enlarged views of the flow diverter. Lastly, FIGS. 8 and 9 show an optional "dual flush" (i.e.: full or partial flush) toilet flushing system.

Referring first to FIGS. 1 to 5, a toilet 10 is provided. Toilet 10 comprises a water reservoir 20 and a toilet bowl 30. Reservoir 20 and toilet bowl 30 are connected by a fluid conduit 40. Fluid conduit 40 has an open bottom end 42 positioned near the bottom of water reservoir 20. Fluid conduit 40 also has a mid section 44 positioned above the top rim of toilet bowl 30. Fluid conduit 40 then opens into a spillway 46 through which water can flow into bowl 30.

A water supply system 50 is also provided. In accordance with the present invention, water supply system 50 is used both to refill the water in reservoir 20 after a flush, and also to initiate a flush when reservoir 20 is full. Water supply system 50 comprises a single water flow line inlet 52 connected to fill valve 54. When fill valve 54 is open, water flows from water inlet 52 through fill valve 54 and out of jet nozzle 56. Fill valve 54 further comprises a float 58. When float 58 is lowered in position, fill valve 54 is opened (thereby supplying water to nozzle 56).

Jet nozzle 56 is directed toward entrance 42 of fluid conduit 40. Thus, when fill valve 54 is opened, water will shoot out of nozzle 56 directly into entrance 42 of fluid conduit 40. As will be explained, the water passing from jet nozzle 56 into entrance 42 of fluid conduit 40 will pull surrounding water in reservoir 20 into fluid conduit 40. This will siphon water from reservoir 20 through fluid conduit 40 and into toilet bowl 30, flushing the bowl.

A flow diverter 60 is located in the reservoir. Flow diverter 60 optionally comprises a float 62 and a moveable gate 64. As will be explained by viewing FIGS. 1 to 5 in sequence, flow diverter 60 is constructed and positioned to divert water flow in one of two different paths. Specifically, flow may be diverted: (a) from jet nozzle 56 into entrance 42 of fluid conduit 40 when reservoir 20 is full, or (b) from jet nozzle 56 away from entrance 42 of fluid conduit 40 and into reservoir 20 when reservoir 20 is empty.

Figure 1:
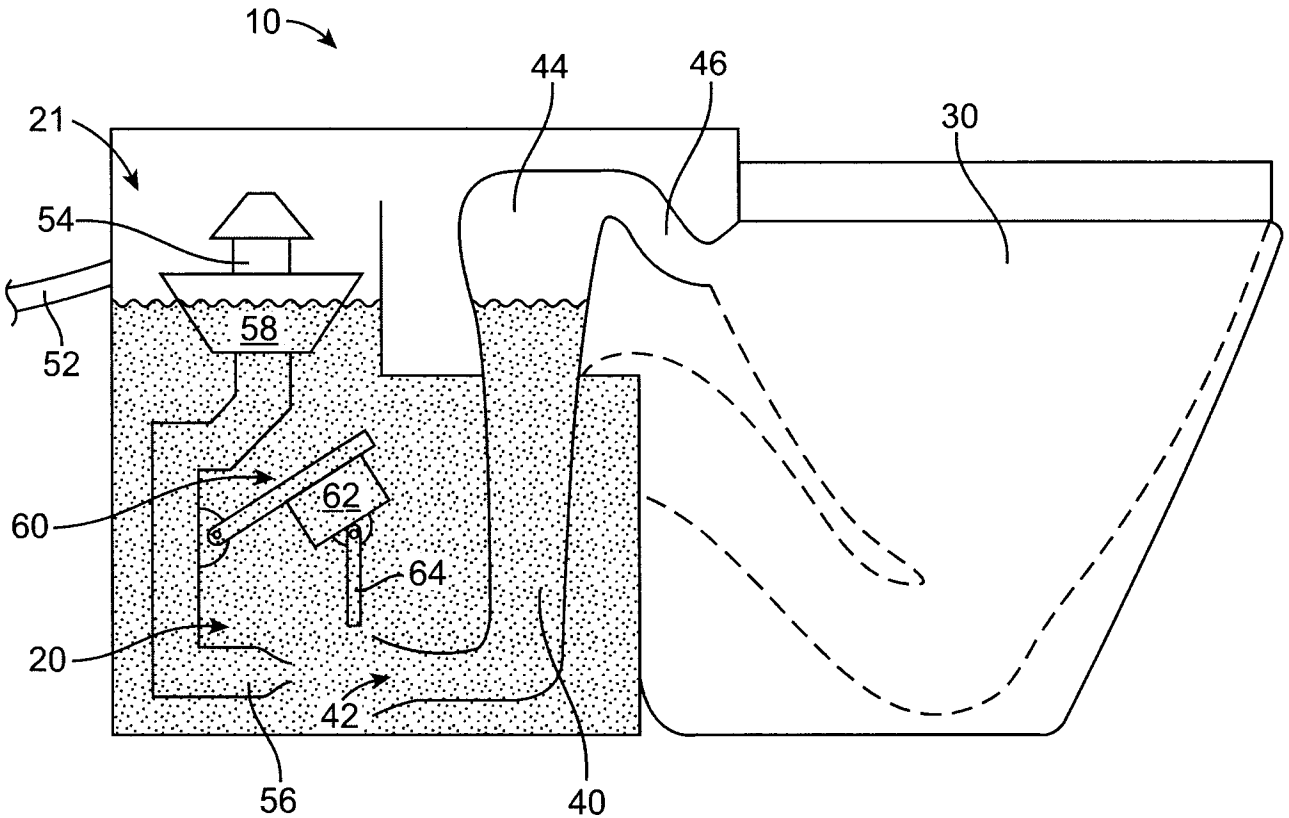
FIG. 1 is a sectional schematic side elevation view of the present system at rest.

Referring first to FIG. 1, the system is shown "at rest" (i.e.: sitting between flushes). In this position, diverter float 62 lifts moveable gate 64 to the position show. Reservoir 20 is full of water.

Figure 2:
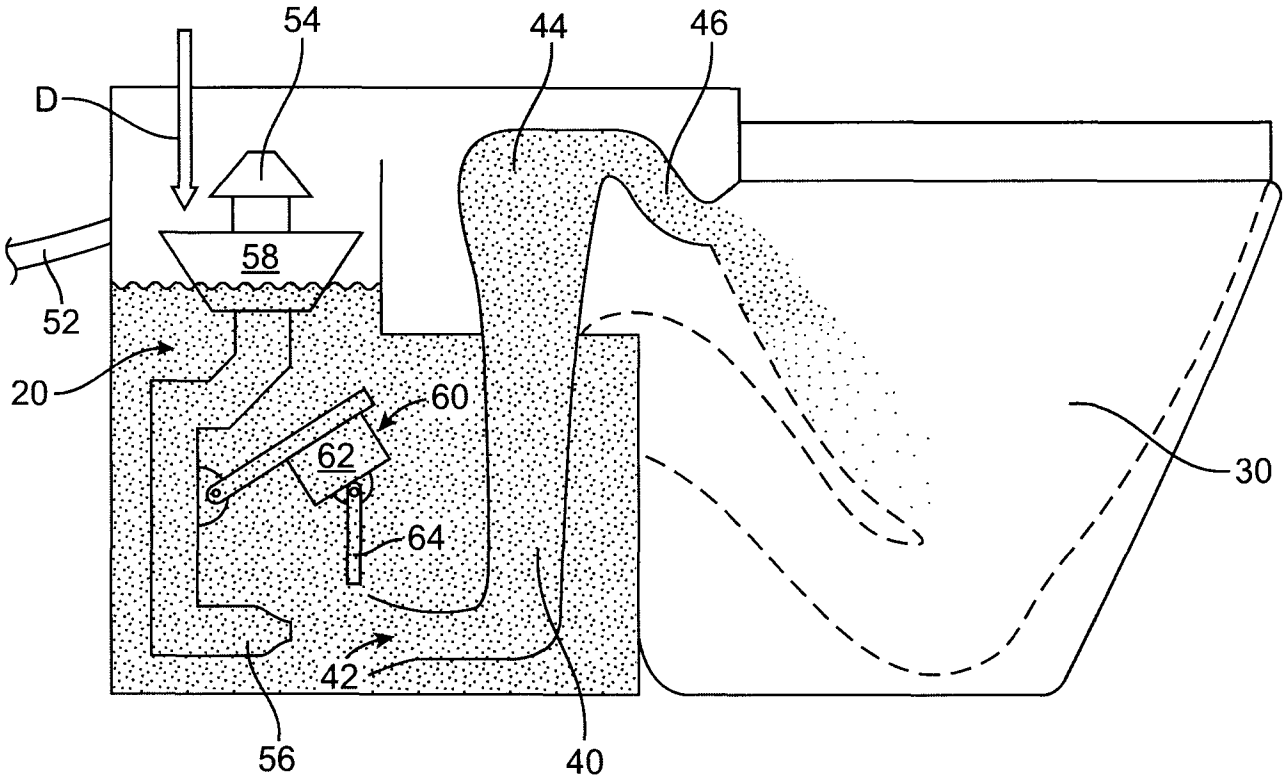
FIG. 2 is a sectional schematic side elevation view of the toilet when the user starts a flush.

Next, in FIG. 2, the user starts to flush the toilet. Specifically, the user manually pushes fill valve float 58 downwards (as shown by arrow "D"). Note: In accordance with the present invention, this may alternately be accomplished by directly pushing down on fill valve float 58, by using any mechanism or linkage to push down on fill valve float 58, or by triggering another mechanism that sends water into jet nozzle 56. When fill valve float 58 has been pushed down, fill valve 54 is then opened, supplying water that flows rapidly out of jet nozzle 56 and into entrance 42 of fluid conduit 40. Because jet nozzle 56 tapers into a relatively small diameter, the pressurized water accelerates through the jet and exits nozzle 56 at a greater velocity than it entered the jet. The water outflow of the jet nozzle 56 heads into entrance 42 of fluid conduit 40. The kinetic energy of the water exiting nozzle 56 is sufficient to overcome gravity and escape reservoir 20, passing up through fluid conduit 40 and then down into toilet bowl 30.

Figure 3:
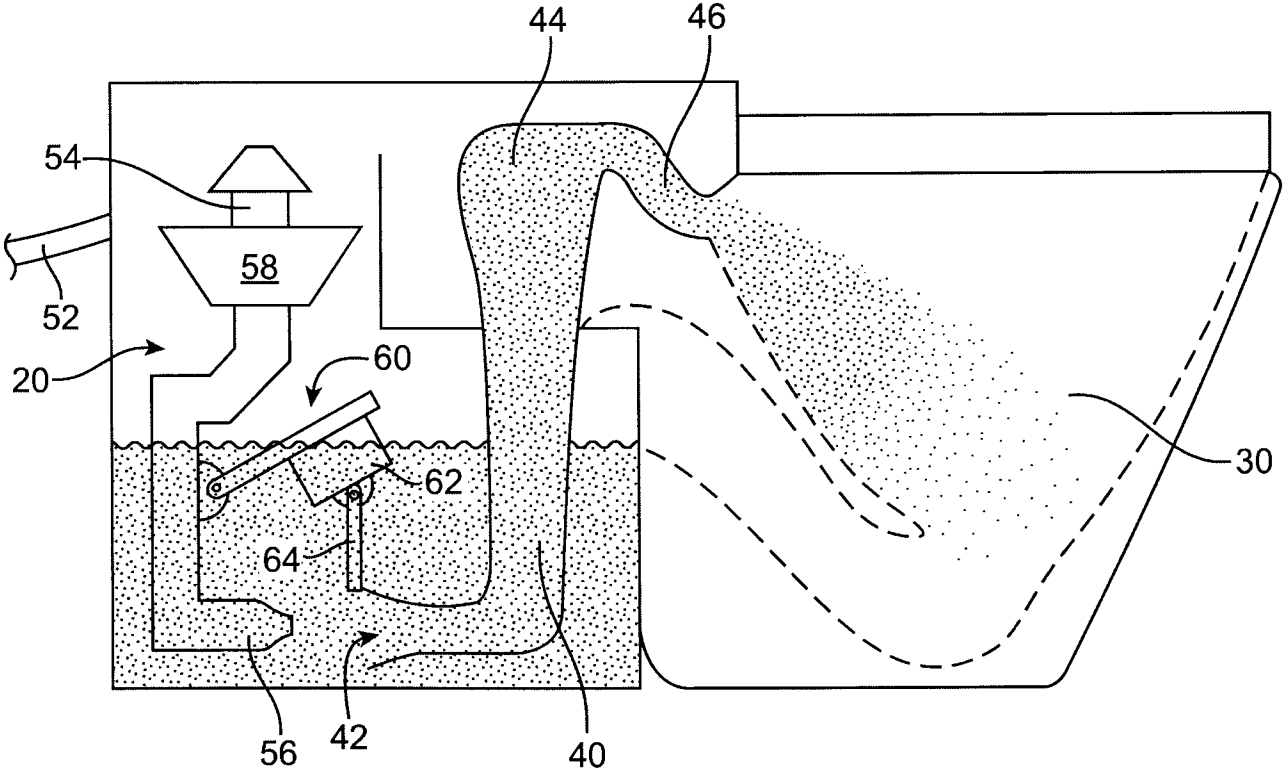
FIG. 3 is a sectional schematic side elevation view of the toilet flushing.

As seen in FIG. 3, once the flow through fluid conduit 40 is established, a siphon effect is created and the water in reservoir 20 is sucked over the U-shaped fluid conduit 40 and into toilet bowl 30, thus providing water for the toilet flush. As can be seen, float 62 begins to drop such that moveable gate 64 starts to lower as the water level in reservoir 20 drops.

Figure 4:
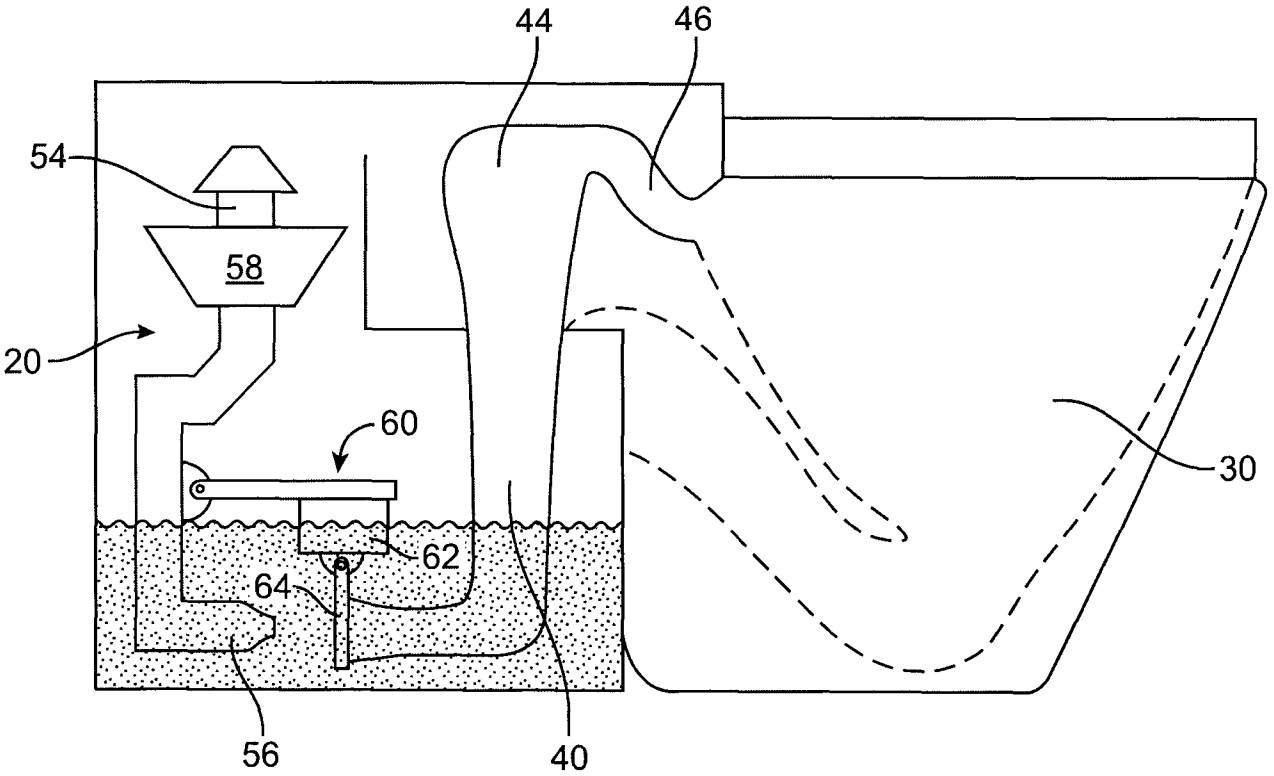
FIG. 4 is a sectional schematic side elevation view of the toilet at the end of the flush.

Finally, as seen in FIG. 4, water reservoir is "emptied". Note: in this context and in the attached claims, "emptied" is understood to mean emptied to the point that the flush has been completed or is being substantially completed. As such, it is not actually necessary that all of the water be removed from reservoir 20 for the reservoir to be "emptied". At this time, float 62 drops to a position such that moveable gate 64 now blocks the entrance 42 to fluid conduit 40.

Figure 5:
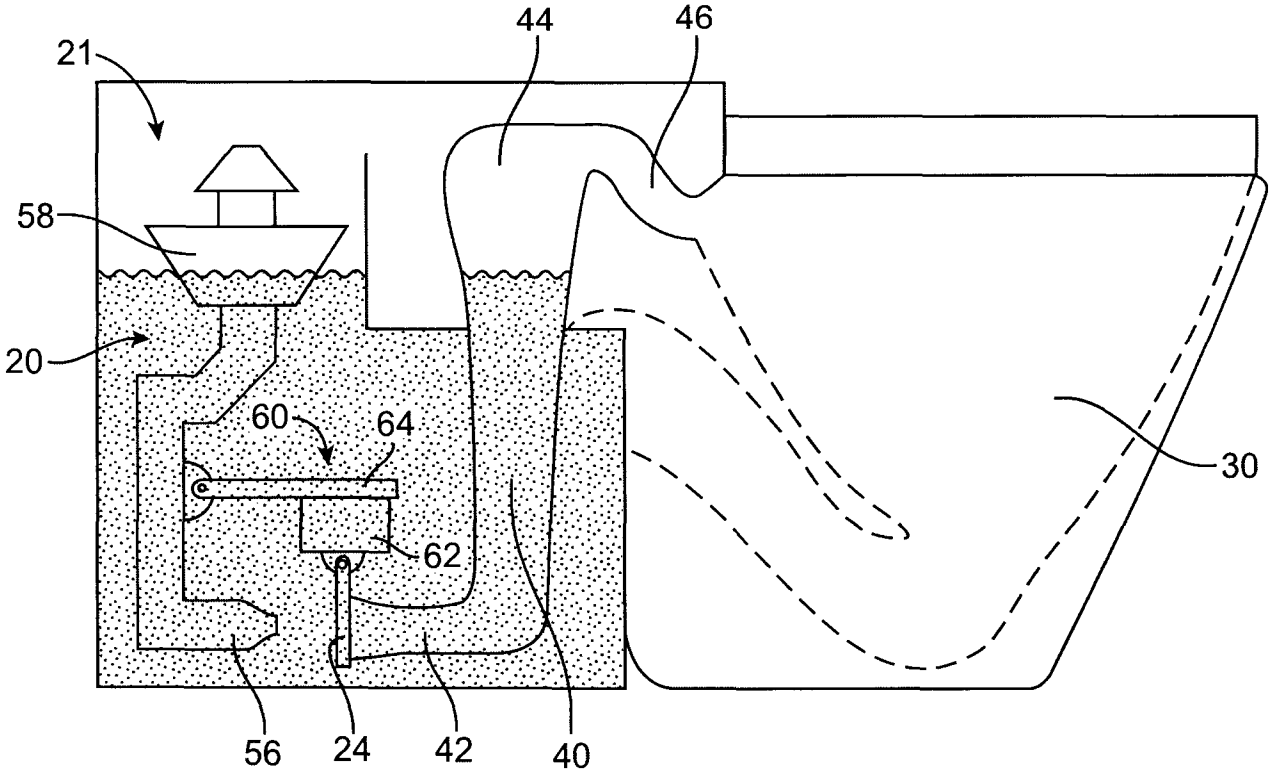
FIG. 5 is a sectional schematic side elevation view of the toilet with the reservoir refilling.

As a result, as seen in FIG. 5, water jetting from nozzle 56 can not pass into fluid conduit 40 and instead simply fills reservoir 20. An optional feature of the invention that can also be seen is that the water pressure shooting from nozzle 56 directly on moveable gate 64 can operate to hold moveable gate 64 at its lowered position (as shown) even as the water level in reservoir 20 rises above float 62.

Finally, after tank 20 has been refilled, fill valve float 58 will be raised by the water level to a position where it shuts off water flow to nozzle 56. As that time, the stream of water shooting from nozzle 56 onto moveable gate 64 will stop. As a result, moveable gate 64 will no longer be held down in its lowered position. Rather, float 62 will lift moveable gate 64 back up to the position as initially shown in FIG. 1 At this time, the flushing cycle is complete, and the toilet is ready for another use in future.

As seen in FIGS. 1 to 5, reservoir 20 may have a narrowed top portion 21. Fill valve float 58 may be positioned within narrowed top portion 21 of reservoir 20. An advantage of having a narrowed top portion 21 to reservoir 20 is that a small change in the fluid volume in reservoir 20 will result in a comparatively large change in vertical position in fill valve float 58. This allows for a faster drop in water level (when reservoir 20 is emptying). Therefore, a user need only depress float 58 for a comparatively short period of time to initiate a flush.

In alternate embodiments, there may be more than one jet nozzle pointed into the mouth of the fluid conduit (to increase the total kinetic energy of the water that shoots over the U-shaped fluid conduit to initiate the flush).

In preferred embodiments, spillway 46 is positioned above the bowl rim to prevent water from the bowl flowing back into the reservoir. In other alternate embodiments, fluid conduit 40 may also have a one-way valve to prevent reverse siphoning ("suck back") from toilet bowl 30 into reservoir 20.

FIGS. 6 and 7 show an enlarged view of a preferred embodiment of flow diverter 60. In this embodiment, diverter 60 is fastened directly onto the input entrance 42 of fluid conduit 40. Float 62 is made of a hollow plastic construction, and gate 64 is made of a solid plastic construction. In FIG. 6, float 62 is in its raised position, lifting moveable gate 64 out of the way so that the jet nozzle can shoot water into the flow diverter (see arrow "W"). In FIG. 7, float 62 is in its lowered position, dropping moveable gate 64 preventing the jet nozzle from shooting water into the flow diverter (see arrow "W"). As can also be seen, fluid conduit 40 may comprise a diverging section 43 that expands in cross-sectional area away from entrance 42 of the fluid conduit. This diverging section operates to improve the efficiency of the jet pump by recovering kinetic energy from the water flowing through conduit 40.

Lastly, FIGS. 8 and 9 show an optional system for operating the present invention with a "dual flush" toilet (i.e.: a toilet in which the user can select either a full or partial flush). This optional system uses a variable buoyancy device mounted onto the float, as follows. As seen in FIG. 8, a cup 66 with an open top end may be rotated by an input lever 68 operated by the user to the position shown. In this position, water in reservoir 20 will flow into cup 66 when it is submerged and out of cup 66 when it is raised above the water's surface. Thus, cup 66 will have no substantial effect on the buoyancy of float 62. Thus, the result will be a "full flush" as described in FIGS. 1 to 5 above.

In contrast, FIG. 9 shows cap 66 rotated to an upwards position such that it holds water therein. In this orientation, cup 66 fills with water when gate 64 is held in the down position (similar to FIG. 5). When the toilet is next flushed, the water level in reservoir 20 will drop below cup 66. However, the added weight of cup 66 (which is now filled with water), will push moveable gate 64 down to its lowered position more quickly. As a result, entrance 42 of fluid conduit 40 will be sealed more quickly and less water will pass from reservoir 20 into toilet bowl 30. Thus, the result will be a "partial flush". Thus, the cup can be positioned to either retain water (FIG. 9) or not retain water (FIG. 8) dependent on the position of lever 68.

Various modifications and alterations of the inventions will become apparent to those skilled in the art without departing from the spirit and scope of the inventions, which are defined by the accompanying claims. For example, the type of flush actuator used may vary widely, and may be mounted in a wide variety of locations including on top of the tank, on the side of the tank, a foot activated actuator on the floor, or a hand activated actuator mounted on the wall behind the toilet and substantially above the toilet. The accompanying claims should be constructed with these principles in mind.

Any element in a claim that does not explicitly state "means for" performing a specified function or "step for" performing a specified function is not to be interpreted as a "means" or "step" clause as specified in 35 U.S.C. §112, ¶6.

What is claimed is:

1. A jet powered toilet flushing system, comprising:

a toilet bowl;

a reservoir;

a fluid conduit between the reservoir and the toilet bowl;

a jet inside the reservoir, the jet having a nozzle directed toward an entrance of the fluid conduit such that flow from the jet into the fluid conduit creates a siphon flow pulling water up out of the reservoir through the fluid conduit and then down into the toilet bowl causing a flush, and wherein all of the water passing from the reservoir to the toilet bowl passes through the fluid conduit;

a fill valve that supplies water to the jet, wherein the fill valve supplies water to the jet prior to the flush commencing, and wherein water from the fill line does not accumulate in the fill valve between flushes but is instead directed straight towards the mouth of the entrance of the fluid conduit when the fill valve is turned on such that the siphon flow is started automatically and without a user pushing a water displacement through the fill valve; and a flow diverter in the reservoir, the flow diverter positioned to divert water flow:

(a) from the jet nozzle into the entrance of the fluid conduit when the reservoir is full, or (b) from the jet nozzle away from the entrance of the fluid conduit and into the reservoir when the reservoir is empty.

2. The system of claim 1, wherein water passing from the jet nozzle into the entrance of the fluid conduit siphons water from the reservoir through the fluid conduit and into the toilet bowl.

3. The system of claim 1, wherein the flow diverter comprises a float and a moveable gate.

4. The system of claim 3, wherein the float lifts the moveable gate away from a fluid path from the jet nozzle into the entrance of the fluid conduit when the reservoir is full.

5. The system of claim 3, wherein the float lowers the moveable gate into a fluid path from the jet nozzle into the entrance of the fluid conduit when the reservoir is empty.

6. The system of claim 5, wherein water flow from the jet nozzle onto the moveable gate keeps the moveable gate in a position blocking the entrance of the fluid conduit after the moveable gate has been lowered into the fluid path.

7. The system of claim 1, wherein the fill valve comprises a fill valve float, and wherein the fill valve supplies water to the jet when the fill valve float is lowered in position.

8. The system of claim 7, wherein the fill valve float is lowered in position when the water level in the reservoir drops after a flush.

9. The system of claim 7, wherein the fill valve float can be manually lowered in position by a user to initiate a flush.

10. The system of claim 7, wherein the reservoir has a narrowed top portion, and wherein the fill valve float is positioned within the narrowed top portion of the reservoir.

11. The system of claim 1, wherein the fluid conduit comprises a diverging section that expands in cross-sectional area away from the entrance of the fluid conduit.

12. The system of claim 3, wherein the flow diverter further comprises a variable buoyancy device mounted onto the float.

13. The system of claim 12 wherein the variable buoyancy device comprises a cup on top of the float and a lever mounted in the reservoir whereby said cup can be positioned to either retain water or not retain water dependent on lever position.

14. The system of claim 1, wherein the fluid conduit comprises a spillway into the toilet bowl, the spillway being positioned higher than a rim of the toilet bowl.

15. The system of claim 1, wherein the fluid conduit has a mid-section positioned higher than a rim of the toilet bowl.

16. A jet powered toilet flushing system, comprising:

a toilet bowl;

a reservoir;

a fluid conduit between the reservoir and the toilet bowl;

a jet inside the reservoir, the jet having a nozzle directed toward an entrance of the fluid conduit such that flow from the jet into the fluid conduit creates a siphon flow pulling water up out of the reservoir through the fluid conduit and then down into the toilet bowl causing a flush, and wherein all of the water passing from the reservoir to the toilet bowl passes through the fluid conduit; and a fill valve that supplies water to the jet, wherein the fill valve comprises a fill valve float, and wherein the fill valve supplies water to the jet when the fill valve float is lowered in position, and wherein the fill valve supplies water to the jet prior to the jet causing flushing to commence, and wherein water from the fill line does not accumulate in the fill valve between flushes but is instead directed straight towards the mouth of the entrance of the fluid conduit when the fill valve is turned on such that the siphon flow is started automatically and without a user pushing a water displacement through the fill valve.

17. The system of claim 16, wherein the fill valve float is lowered in position when the water level in the reservoir drops after a flush.

18. The system of claim 16, wherein the fill valve float can be manually lowered in position by a user to initiate a flush.

19. The system of claim 16, wherein the reservoir has a narrowed top portion, and wherein the fill valve float is positioned within the narrowed top portion of the reservoir.

20. The system of claim 1, wherein the entrance to the fluid conduit is positioned below the exit of the fluid conduit.

21. The system of claim 16, wherein the entrance to the fluid conduit is positioned below the exit of the fluid conduit.

* * * * *